US005694748A

United States Patent [19]

Rochman et al.

[11] Patent Number: 5,694,748

[45] Date of Patent: Dec. 9, 1997

[54] APPARATUS FOR ENCIRCLING ITEMS WITH TAPE

[76] Inventors: Eyal Rochman, 8 Pinsker St.; Tzur Rochman, 13 Habroshim St., both of Nahalat Yehuda, Rishon Lezion, Israel

[21] Appl. No.: 627,204

[22] Filed: Apr. 3, 1996

[51] Int. Cl.[6] ..... B65B 51/04; B65B 13/10

[52] U.S. Cl. ..... 53/588; 53/137.2

[58] Field of Search ..... 53/588, 139.1, 53/137.2; 100/27; 242/416, 420, 423.1, 423.2

[56] References Cited

U.S. PATENT DOCUMENTS

| | | | |
|---|---|---|---|
| 2,743,562 | 5/1956 | Dawson et al. . | |
| 2,863,270 | 12/1958 | Elmer, Jr. . | |
| 2,945,336 | 7/1960 | Anderson et al. . | |
| 2,972,843 | 2/1961 | Du Broff . | |
| 3,003,297 | 10/1961 | Broadhead et al. . | |
| 3,974,974 | 8/1976 | Nishikawa | 242/423.2 |
| 4,103,472 | 8/1978 | Heringer | 53/137.2 |
| 4,178,739 | 12/1979 | Du Broff . | |
| 4,915,319 | 4/1990 | Gerber | 242/423.1 |
| 5,417,787 | 5/1995 | Tanaka . | |

FOREIGN PATENT DOCUMENTS

| | | | |
|---|---|---|---|
| 1514664 | 10/1989 | U.S.S.R. | 53/588 |

*Primary Examiner*—Linda Johnson
*Attorney, Agent, or Firm*—Mark M. Friedman

[57] ABSTRACT

An apparatus for encircling items with tape includes a spool assembly for dispensing the tape, a displacement mechanism for displacing the spool assembly in a closed path about the items, and a tape control mechanism. The tape control mechanism has a rod rotatable about its longitudinal axis. The rod assumes a primed state in which it is disposed between the closed path and the items and is locked to rotation thereby allowing the tape to become caught thereon. The rod also assumes a release state in which the rod is free to rotate thereby facilitating peeling away of the tape from the rod. The spool assembly preferably includes a spool for supplying the tape, a spring element attached to the spool so as to bias the spool to recoil, and a rotatable friction mount for releasing excess tension in the spring element.

11 Claims, 10 Drawing Sheets

APPARATUS FOR ENCIRCLING ITEMS WITH TAPE

FIELD AND BACKGROUND OF THE INVENTION

The present invention relates to packaging and, in particular, it concerns an apparatus for encircling one or more items with tape.

It is known to use adhesive tape to attach or wrap items. Many attempts have been made to develop automated systems for applying tape to various items.

U.S. Pat. No. 2,863,270 to Elmer discloses a manually operated tape applying device. The tape must be manually attached to the items to be taped at the beginning of each taping operation and manually cut on completion. U.S. Pat. No. 2,945,336 to Anderson et al. discloses another manually operated tape applying devices. In this case, the tape is automatically cut at the end of each revolution. Both the devices of Elmer and Anderson et al. require manual priming before every taping operation.

More fully automated systems are disclosed in U.S. Pat. No. 2,743,562 to Dawson et al., U.S. Pat. Nos. 2,972,843 and 4,178,739 to Du Broff, and U.S. Pat. No. 3,003,297 to Broadhead et al. Each of the systems provides a complex combination of mechanical and/or electrical components to achieve automatic cutting and priming of the tape between operations.

The complexity of these automated taping systems generally causes them to be expensive to produce and unreliable in operation. Furthermore, these systems are typically unable to apply a double winding of tape in a single taping operation.

An additional problem with the prior art taping devices is their sensitivity to alignment of the items to be taped. If the items are not positioned at the center of rotation of the tape applicator, slack may be generated in the tape leading to uneven taping and possible jamming of the device.

There is therefore a need for an apparatus for encircling one or more items with tape which is of simple and robust design, allows application of a double winding of tape, and takes up any slack which may arise in the tape during taping.

SUMMARY OF THE INVENTION

The present invention is of an apparatus for encircling items with tape.

According to the teachings of the present invention there is provided, an apparatus for encircling at least one item with tape, the apparatus comprising: (a) a spool assembly for dispensing the tape including: (i) a spool for supplying the tape, (ii) a spring element attached to the spool so as to bias the spool to recoil, and (iii) a rotatable friction mount for releasing excess tension in the spring element; and (b)a displacement mechanism for displacing the spool assembly in a closed path about the at least one item.

According to a further feature of the present invention, the spring element biases the spool to recoil in excess of one revolution.

According to a further feature of the present invention, the displacement mechanism includes a rotatable arm mounted on a hollow shaft, the apparatus further comprising a table for supporting the at least one item, the table being supported by a bar which extends through the hollow of the hollow shaft.

According to a further feature of the present invention, there is also provided a tape control mechanism including a rod rotatable about its longitudinal axis, the rod assuming a primed state in which the rod is disposed between the closed path and the at least one item and is locked to rotation thereby allowing the tape to become caught thereon, and a release state wherein the rod is free to rotate thereby facilitating peeling away of the tape from the rod.

According to a further feature of the present invention, the tape control mechanism further includes a flat stop, and wherein the rod is of polygonal section, the rod being rotatable around an axis passing perpendicular thereto between a position in which it abuts the flat stop corresponding to the primed state, and a position rotated away from the flat stop corresponding to the release position.

According to a further feature of the present invention, there is also provided a mechanical linkage linking between the displacement mechanism and the tape control mechanism, the mechanical linkage rotating the rod from its primed state to its release state when the spool assembly has rotated through at least a quarter revolution.

According to a further feature of the present invention, the mechanical linkage includes a cam associated with the displacement mechanism such that one revolution of the cam corresponds to a plurality of revolutions of the spool assembly.

According to the teachings of the present invention there is also provided an apparatus for encircling at least one item with tape, the apparatus comprising: (a) a spool assembly for dispensing the tape; (b) a displacement mechanism for displacing the spool assembly in a closed path about the at least one item; and (c) a tape control mechanism including a rod rotatable about its longitudinal axis, the rod assuming a primed state in which the rod is disposed between the closed path and the at least one item and is locked to rotation thereby allowing the tape to become caught thereon, and a release state wherein the rod is free to rotate thereby facilitating peeling away of the tape from the rod.

According to a further feature of the present invention, the tape control mechanism further includes a flat stop, and wherein the rod is of polygonal section, the rod being rotatable around an axis passing perpendicular thereto between a position in which it abuts the flat stop corresponding to the primed state, and a position rotated away from the flat stop corresponding to the release position.

According to a further feature of the present invention, there is also provided a mechanical linkage linking between the displacement mechanism and the tape control mechanism, the mechanical linkage rotating the rod from its primed state to its release state when the spool assembly has rotated through at least a quarter revolution.

According to a further feature of the present invention, the mechanical linkage includes a cam associated with the displacement mechanism such that one revolution of the cam corresponds to two revolutions of the spool assembly.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of an apparatus for encircling items with tape.

The principles and operation of an apparatus according to the present invention may be better understood with reference to the drawings and the accompanying description.

Figure 1A:
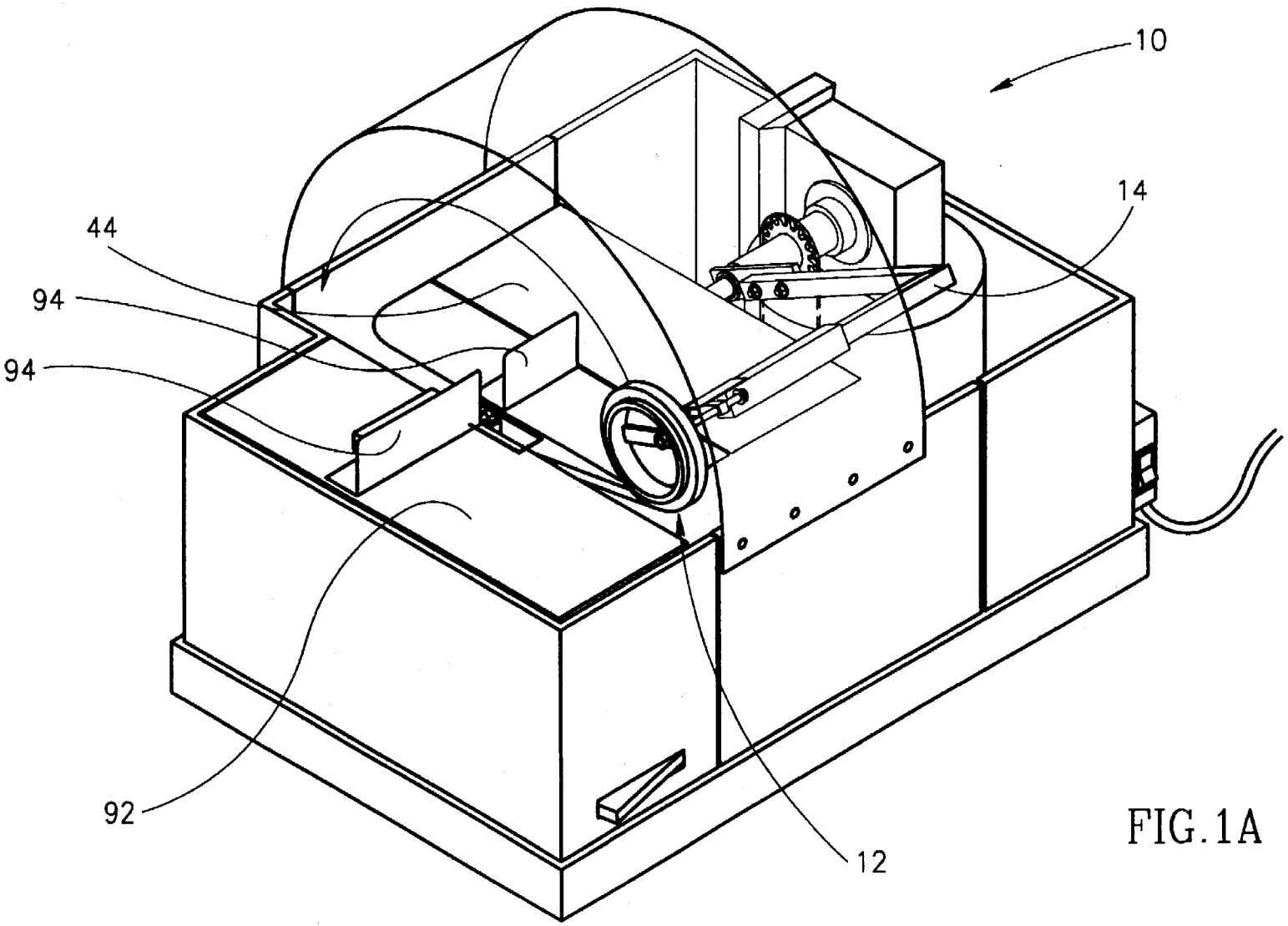
FIG. 1A is a perspective view of an apparatus, constructed and operative according to the teachings of the present invention, for encircling one or more items with tape.
Figure 1B:
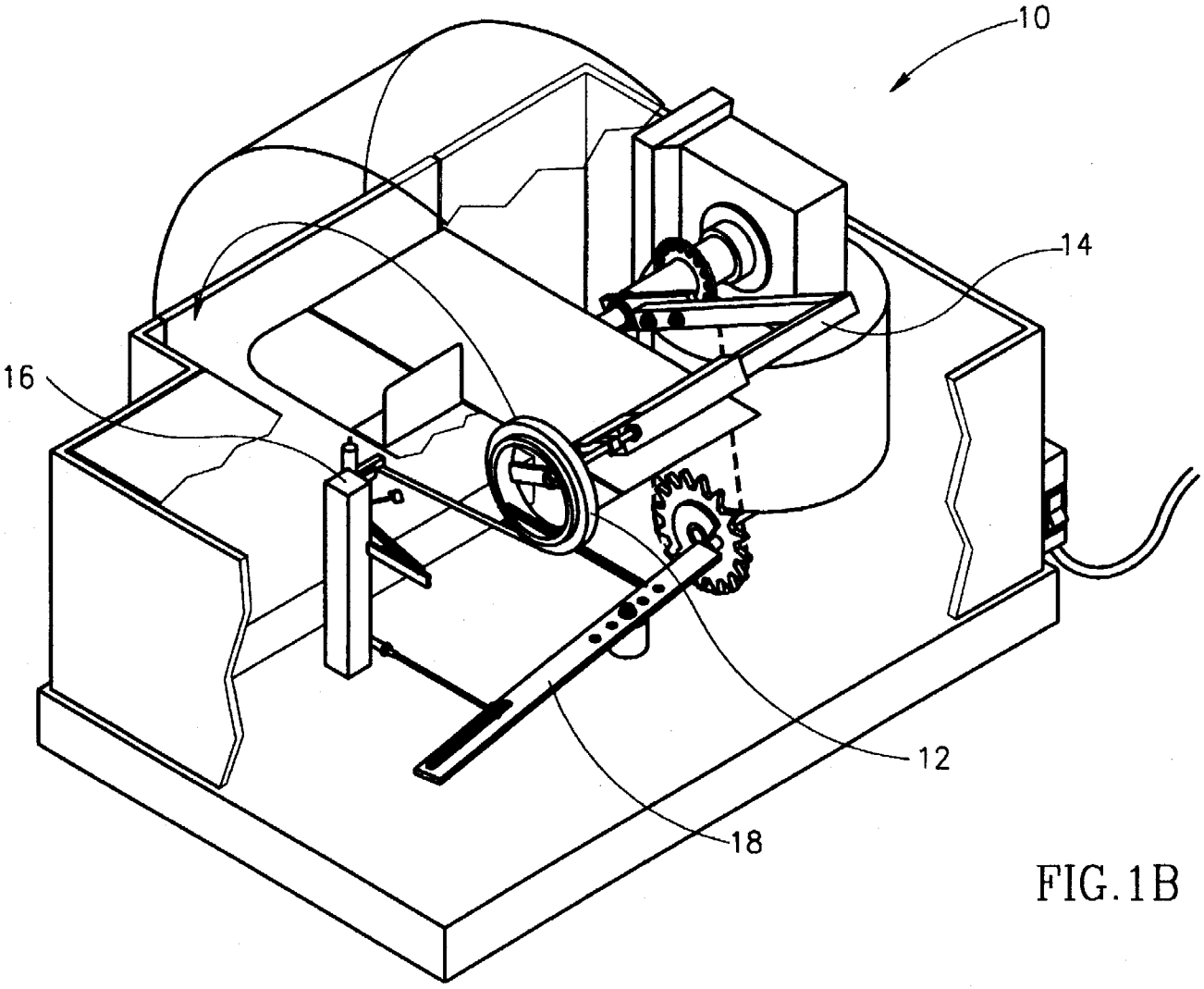
FIG. 1B is a partially cut-away perspective view of the apparatus of FIG. 1A.

Referring now to the drawings, FIGS. 1A and 1B show an apparatus, generally designated 10, constructed and operative according to the teachings of the present invention, for encircling one or more items with tape. Generally speaking, the apparatus includes a spool assembly 12 for dispensing the tape mounted on a rotatable arm 14. Rotation of rotatable arm 14 moves spool assembly 12 in a closed path about the items so as to encircle the items with tape. Apparatus 10 preferably also features a tape control mechanism 16 for retaining and cutting the tape as required. Tape control mechanism 16 is actuated and synchronized through a mechanical linkage 18 linking it to rotatable arm 14.

The present invention will be described herein in relation to an embodiment having a rotatable arm. However, it should be appreciated that the invention may equally be implemented with any suitable displacement mechanism which moves spool assembly 12 in the required closed path about the items to be taped. In particular, an embodiment using a track-based displacement mechanism may be structurally advantageous and particularly reliable.

It should also be appreciated that the present invention may be used with a very wide range of types of tape and other band-like materials which are to be applied to items. Examples include, but are not limited to, PVC tapes, paper-based tapes and various types of plastics and other polymers which adhere with or without adhesives. For the purpose of the following description and claims, all or any such materials will be referred to individually or collectively as "tape".

Turning now to the features of apparatus 10 in more detail, these will be described in turn with reference to FIGS. 2–6.

Figure 2:
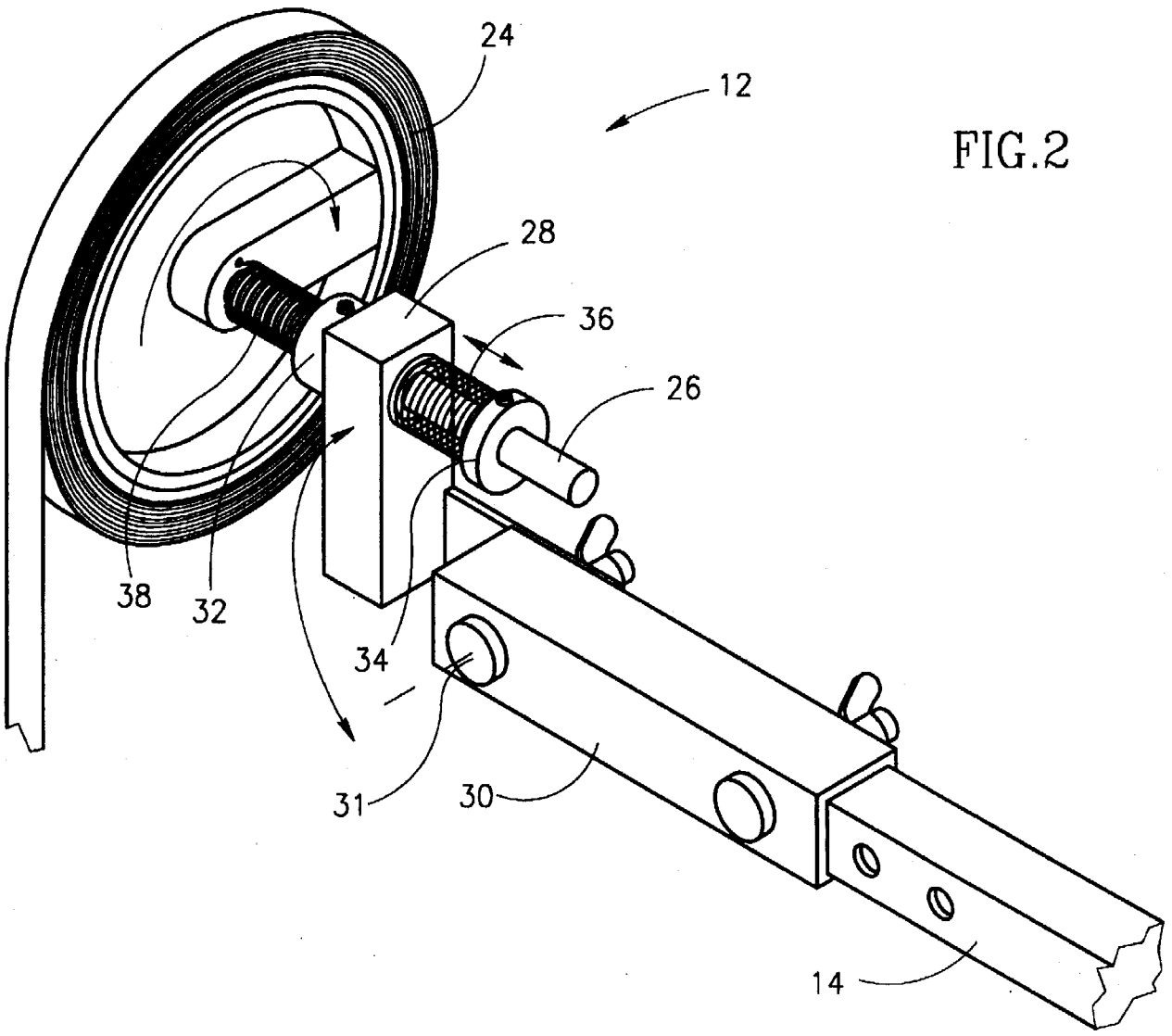
FIG. 2 is an enlarged perspective view of a spool assembly for dispensing the tape for use in the apparatus of FIG. 1A.

It is a particular feature of a preferred embodiment of the present invention that spool assembly 12 includes a mechanism for preventing slack from arising in the tape. FIG. 2 shows an example of spool assembly 12 including such a mechanism, and FIG. 3 illustrates the importance of the mechanism.

Figure 3:
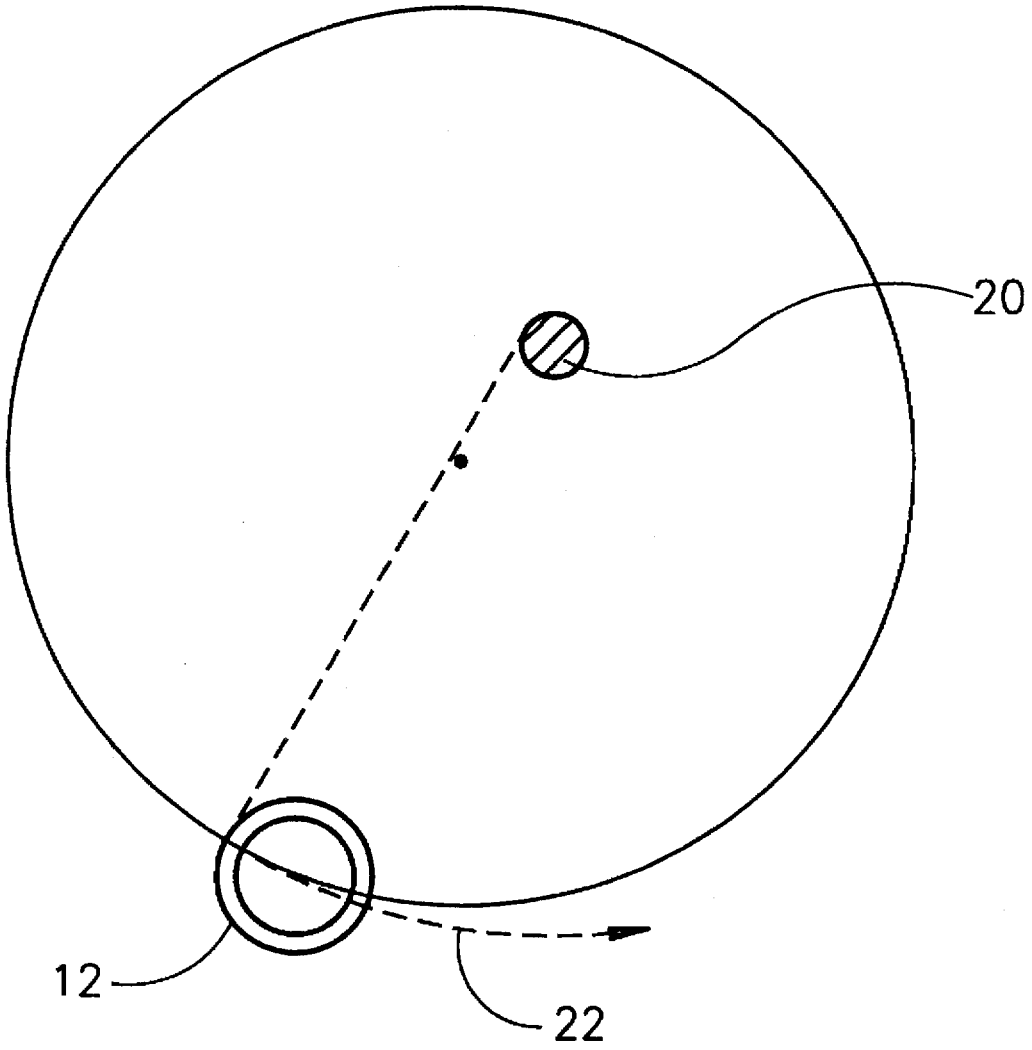
FIG. 3 is a schematic cross-sectional view of the spool assembly of FIG. 2 in operation.

Referring first to FIG. 3, this illustrates a case in which an item 20 being taped is positioned away from the center of the path taken by spool assembly 12. This situation can often arise when a narrow section of a larger item such as the stems of a large bunch of flowers is being taped. Furthermore, the ability to accommodate items which are not located centrally to the path of spool assembly 12 allows apparatus 10 to tape a wide range of sizes and shapes of articles without requiring adjustment. This feature consequently enables use of a large proportion of the area enclosed by the path of spool assembly 12 such that apparatus 10 can be more compact than conventional taping systems for similar sized items.

Dashed line 22 represents an arc of radius equal to the length of free tape between item 20 and spool assembly 12. The trajectory of spool assembly 12 as shown is directed inwards of this arc, indicating a likelihood of generating slack in the tape between spool assembly 12 and item 20. If slack is allowed to form, the quality of taping will deteriorate, and tangling or jamming of apparatus 10 may result. In this case, the slack-preventing mechanism of the present invention maintains tension in the tape, thereby ensuring consistent and trouble-free taping operation.

Turning now to FIG. 2, spool assembly 12 includes a spool 24 rotatably mounted on a pin 26 which is, in turn, rotatably within a hole in a block 28. Block 28 is attached by means of an adjustable bracket 30 to arm 14. Adjustable bracket 30 preferably allows alteration of the inclination of block 28 relative to arm 14 about bolt 31.

Spool assembly 12 features a friction brake formed by a first lug 32 and a second lug 34 attached to pin 26 on opposite sides of block 28. A main spring 36 disposed around pin 26 between block 28 and second lug 34 generates frictional contact between first lug 32 and block 28, thereby inhibiting free rotation of pin 26. For ease of reference, an attachment of this type in which one element is mounted rotatably relative to a second and in which rotation is inhibited by frictional resistance will be referred to herein in the specification and claims as a "rotatable friction mount". A secondary spring 38 is attached at one end to spool 24 and at the other end to first lug 32 so that it becomes coiled by rotation of spool 24 relative to pin 26.

The operation of spool assembly 12 is as follows. A reel of tape is attached to spool 24 and the end of the tape is drawn out to its starting position which will be described in detail below. The process of withdrawing the tape turns spool 24 relative to pin 26 thereby winding up secondary spring 38. Secondary spring 38 then has the effect of biasing spool 24 in the direction indicated by an arrow so as to tend to take-up any slack in the tape. During the winding of secondary spring 38, pin 26 is inhibited from turning relative to arm 14 by the friction-braking effect of main spring 36.

During operation of apparatus 10, spool 24 continues to be turned against the bias of secondary spring 38 as tape is applied to the items being taped. When secondary spring 38 becomes fully wound, typically after at least one and preferably about two revolutions, further tension applied to the tape generates an increased moment directly on first lug 32 which overcomes the effect of the friction between first lug 32 and block 28 to turn pin 26. During subsequent operation of apparatus secondary spring 38 generally remains fully wound as first pin 26 continues to turn relative to block 28. If, however, conditions of slack occur in the tape, secondary spring 38 absorbs the slack and maintains the tension required for optimal operation of apparatus 10.

An additional preferred feature of spool assembly 12 is that the inclination of spool 24 may be varied relative to arm 14, as shown. A problem may be encountered when taping around conical or otherwise non-parallel-sided items. The problem is caused by the tendency of the tape to follow a linear path on the surface of the items, corresponding to a spiral path in three-dimensional space. This tendency may be compensated by slightly inclining spool 24 so as to provide an opposite effect.

Figure 4A:
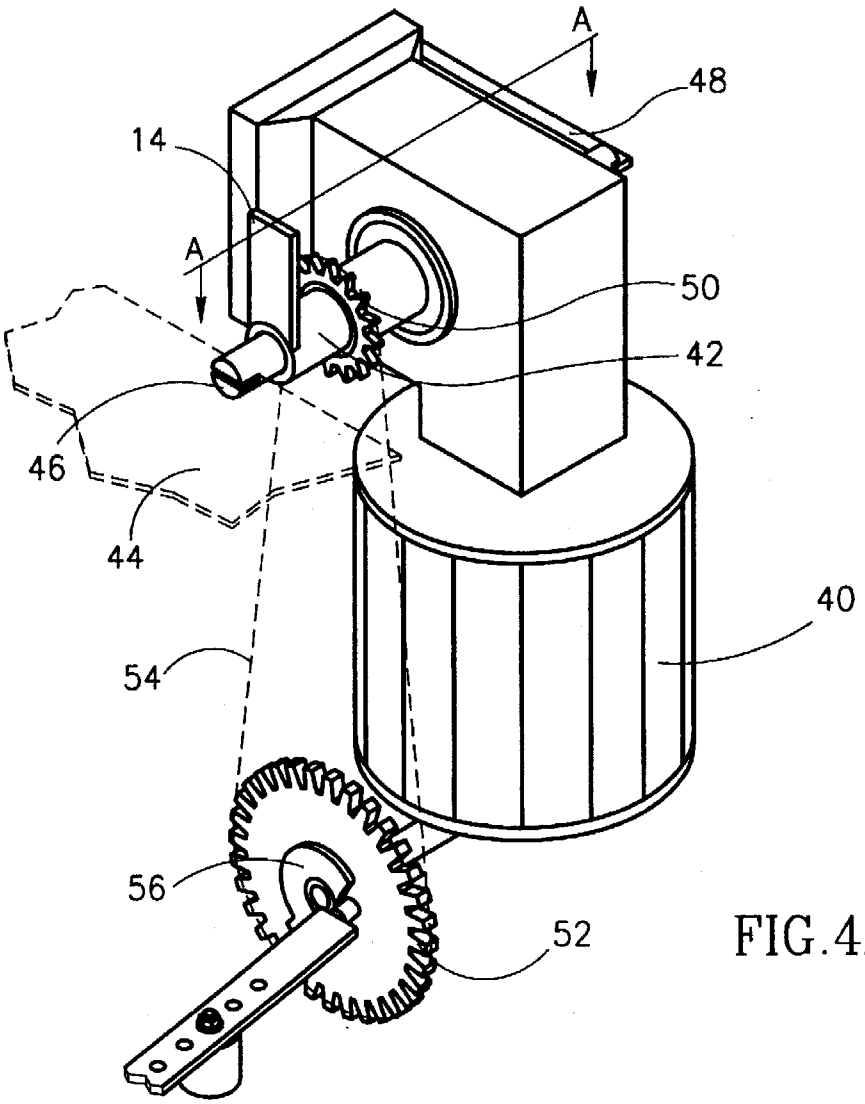
FIG. 4A is a perspective view of a drive mechanism and an axially-mounted table for use in the apparatus of FIG. 1A.
Figure 4B:
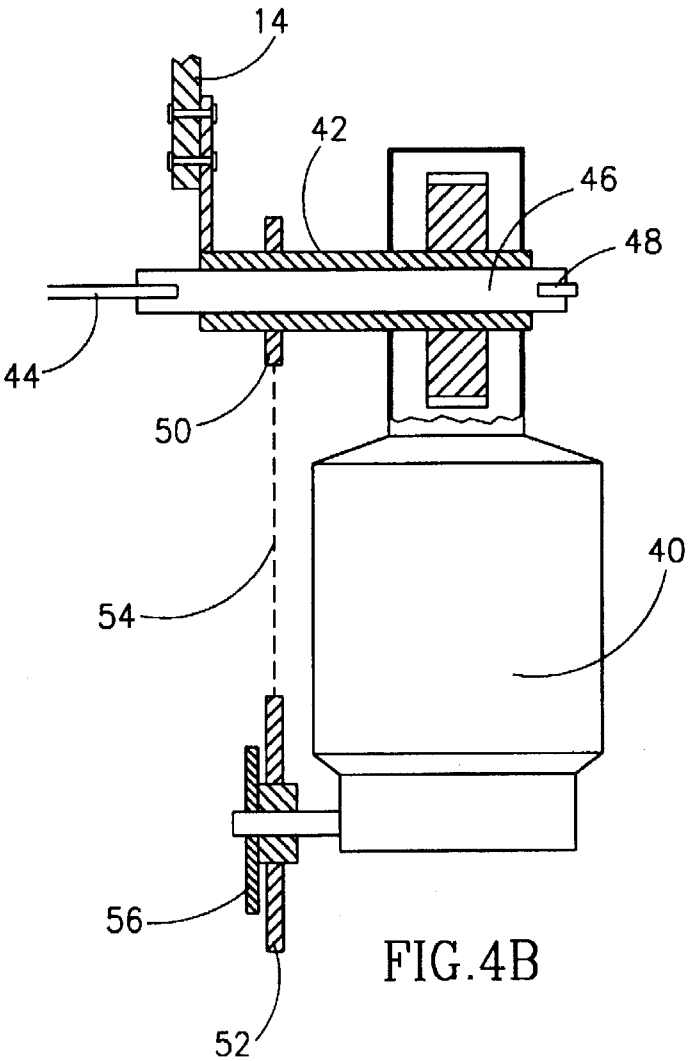
FIG. 4B is a cross-sectional view along the line A—A of FIG. 4A.

Turning now to FIGS. 4A and 4B, these show the drive mechanism of apparatus 10. Specifically, apparatus 10 features an electric motor 40 which drives a hollow shaft 42 on which rotatable arm 14 is mounted. Electric motor 40 is typically activated by a microswitch responsive to positioning of an item or items ready for taping. It then performs a predetermined number of revolutions corresponding to two revolutions of arm 14 before automatically stopping. Electric motor 40 preferably includes a safety clutch operative to interrupt operation of rotatable arm 14 in the case that the arm meets resistance to its movement. Alternatively, a detachable or easily-fracturing section may be included in the structure of rotatable arm 14, itself.

It is a preferred feature of the present invention that apparatus 10 includes a table 44 for supporting items to be taped within the volume encircled by rotation of arm 14, as seen in FIGS. 1A and 1B. In order to hold table 44 in the required position, it is attached to a bar 46 which extends through the axial hollow of hollow shaft 42. Rotation of bar 46 is prevented by a key 48 engaged in a slot cut in the part of bar 46 which extends from the back of hollow shaft 42.

In order to operate mechanical linkage 18, hollow shaft 42 features a toothed flange 50 which drives a gear wheel 52 through a chain represented by a dashed line 54. Gear wheel 52 carries a shaped cam 56 which provides synchronized operation of tape control mechanism 16, as will be described below. It is a particular feature of a preferred embodiment of the present invention that gear wheel 52 features double the number of teeth of toothed flange 50. This means that one rotation of cam 56 corresponds to two revolutions of arm 14 and hence a double winding of tape. If larger numbers of windings are required, apparatus 10 may readily be adapted by replacing gear wheel 52 with another gear wheel having the appropriate multiple of the number of teeth of toothed flange 50.

Figure 5:
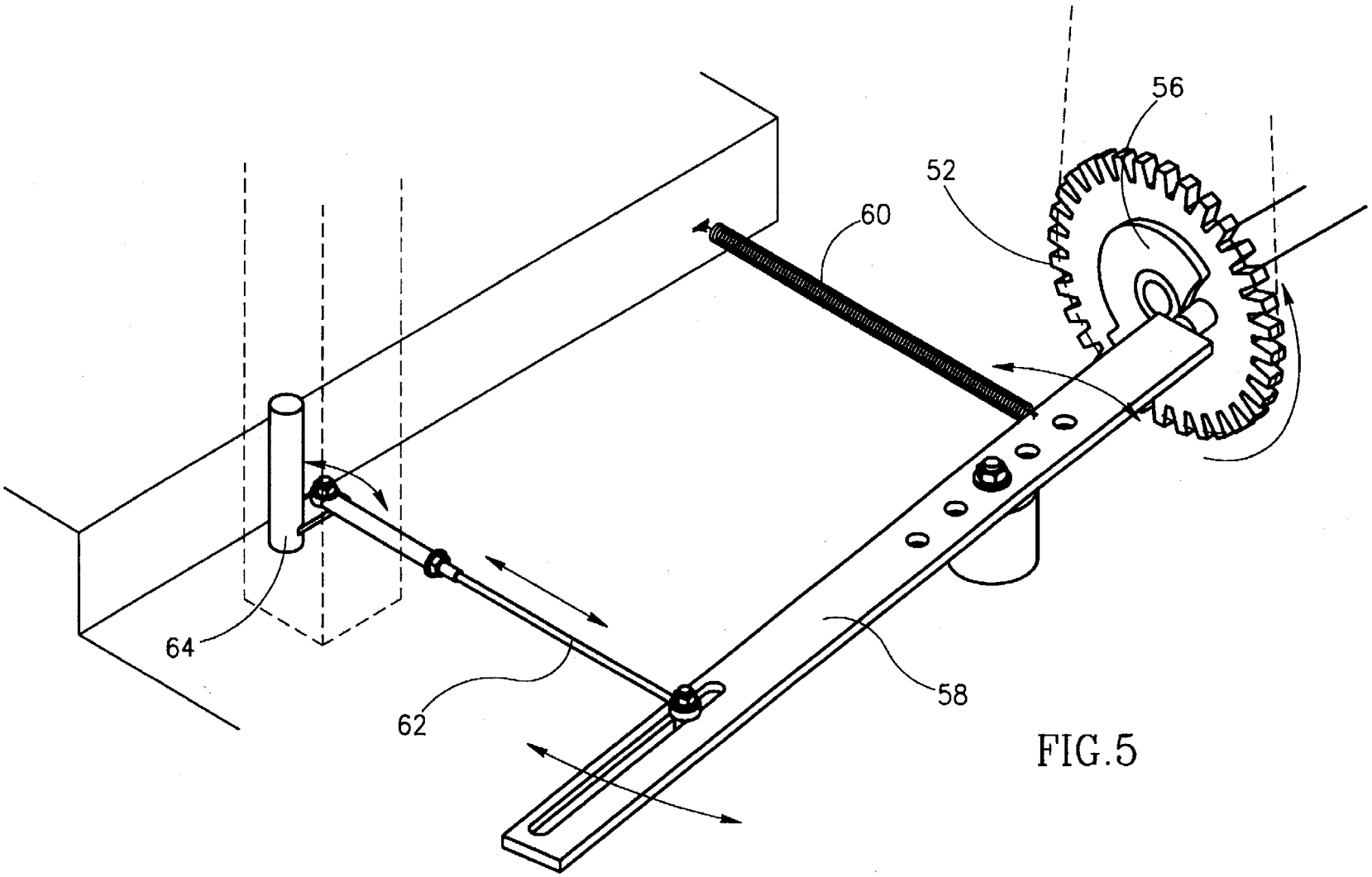
FIG. 5 is an enlarged perspective view of a mechanical linkage for use in the apparatus of FIG. 1A.

Further details of mechanical linkage 18 are shown in FIG. 5. The structure shown is a simple combination of a pivoted lever 58 urged by a spring 60 against shaped cam 56. An adjustable actuator rod 62 converts pivotal movements of lever 58 to rotation of a vertical axle 64. The details of the shape of cam 56 will be readily deduced by one ordinarily skilled from the description of the required rotation of axle 64 which follows.

Figure 6A:
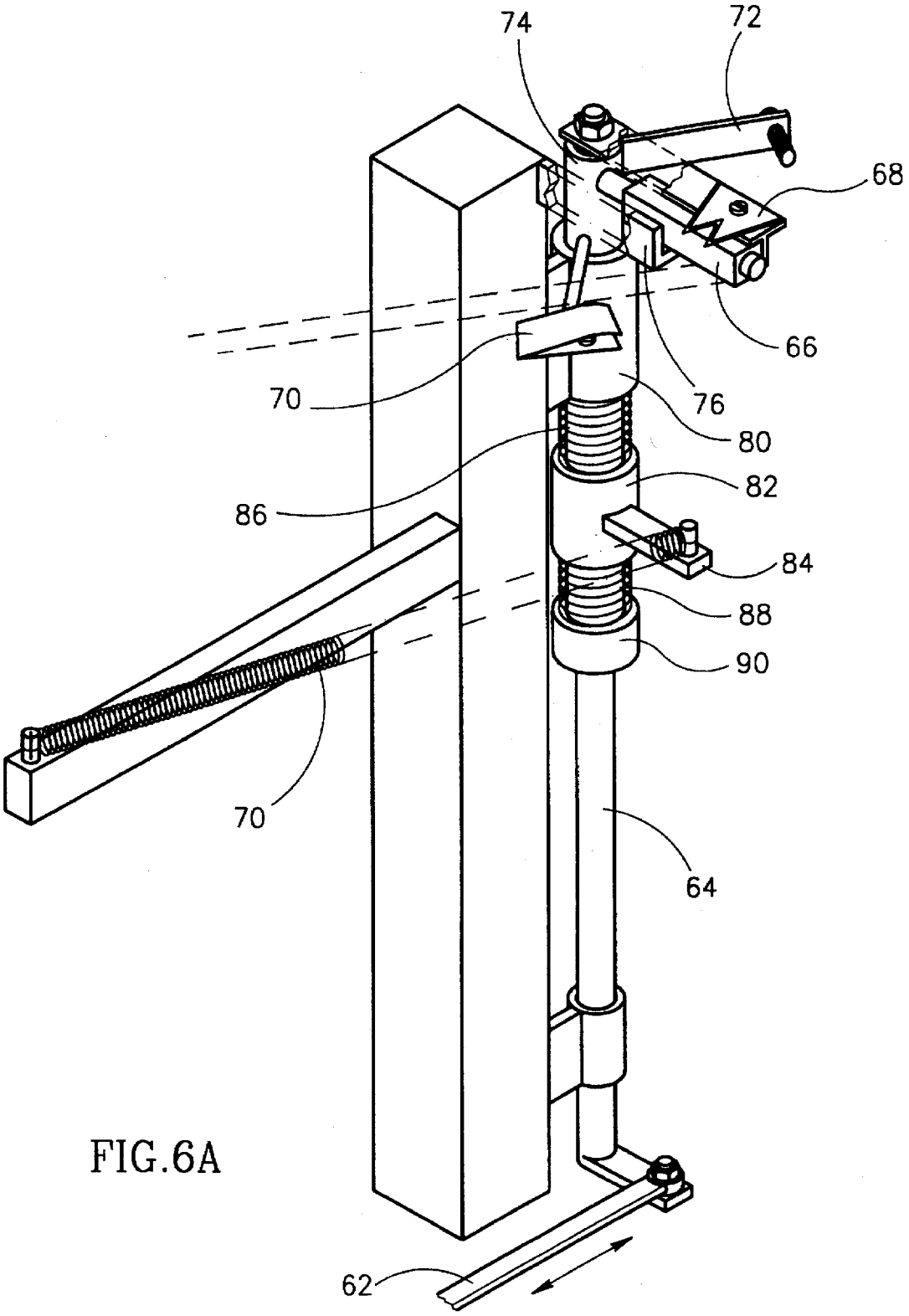
FIGS. 6A, 6B and 6C are enlarged perspective views of a tape control mechanism in a resting state, a primed state and a release state, respectively, for use in the apparatus of FIG. 1A.

Turning now to the features of tape control mechanism 16, this will be described with reference to FIGS. 6A, 6B and 6C. Generally speaking, tape control mechanism 16 includes a rod 66, rotatable about its longitudinal axis, which assumes a primed state in which it is disposed in the path of the tape and is locked to rotation, and a release state in which it is free to rotate. The primed state allows the tape to become caught on rod 66 so as to maintain the end of the tape in the required position, whereas the release state facilitates peeling away of the tape from rod 66.

Rod 66 preferably has a polygonal cross-section of which the square cross-section shown is a typical example. This allows rotational locking to be achieved simply by abutting a stop having a flat surface. Alternatively, a circular rotatable rod may be used with locking performed by friction or any other suitable mechanism. Rod 66 preferably has a high friction surface which facilitates attachment of the tape. A layer of PVC or paper-based tape generally provides a particularly suitable surface.

Tape control mechanism 16 also includes a blade 68 for cutting the tape and preferably also a resilient finger 70 for controlling a loose end of the tape.

Rod 66, finger 70 and a blade stop 72 are all mounted extending in different directions on a rotatable collar 74. In an initial position as shown in FIG. 6A, rod 66 is in a central position against a fixed central stop 76 with blade stop 72 rotated anti-clockwise from it by about 30°–50° and finger 70 rotated clockwise therefrom by a similar angle, as viewed from above. Rotatable collar 74 extends downwards through a hinge 80 and terminates in a flange 82 having a projection 84. A spring 78, attached to projection 84, urges rotatable collar 74 to turn so as to maintain rod 66 against central stop 76. An additional spring 86 is disposed around axle 64 between flange 82 and hinge 80 maintains the vertical position of rotatable collar 74.

Blade 68 is fixed so as to rotate with vertical axle 64. A further spring 88 disposed around axle 64 between flange 82 and a flange 90 on axle 64 maintains the vertical position of blade 68.

This structure enables all of the elements of tape control mechanism 16 to be actuated by a single mechanical linkage 18. Specifically, in the initial position shown in FIG. 6A, blade 68 abuts rod 66 which, in turn, abuts central stop 76. As actuator rod 62 rotates vertical axle 64, blade 68 turns outwards until it abuts blade stop 72, as shown in FIG. 6B. Further rotation of blade 68 then drags rotatable collar 74 against the tension of spring 78 so that rod 66 moves out of contact with central stop 76. Rod 66 is then free to rotate. The extreme position of blade 68 brings resilient finger 70 into a central position as shown in FIG. 6C.

Apparatus 10 typically features a front table 92, as seen in FIG. 1A, which covers tape control mechanism 16 during use. One, or both, of table 44 and front table 92 may be provided with a vertical fin 94 for helping to align items to be taped. A microswitch 96 is preferably attached to front table 92 for actuating apparatus 10 automatically when items to be taped are placed in position.

Figure 7A:
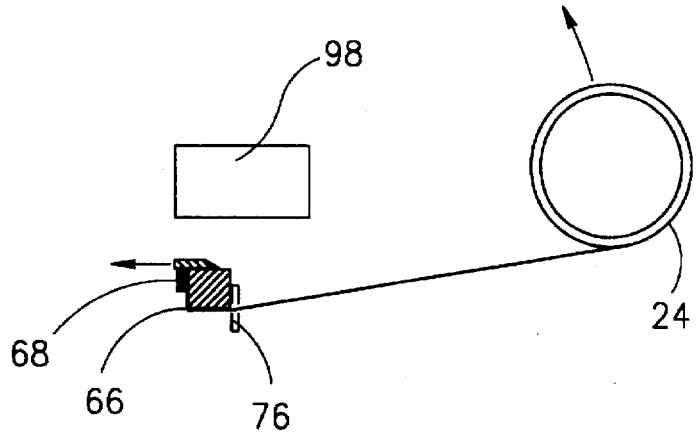
FIGS. 7A, 7B, 7C, 7D and 7E are a sequence of cross-sectional views in the plane of taping illustrating the operation of the apparatus of FIG. 1A.

The operation of apparatus 10 will now be described with reference to FIGS. 7A to 7E. FIG. 7A shows the initial primed position of spool 24, rod 66, blade 68 and central stop 76 when an item 98 is placed in position ready to be taped. In this position, the tape is attached to two sides of rod 66 which is locked to rotation by abutting central stop 76. A vertical ridge in blade 68 further helps to clamp the tape in position. As apparatus 10 is activated, either by a microswitch or manually, spool 24 starts to encircle item 98. At the same time, mechanical linkage 18 causes blade 68 to start to open.

Figure 7B:
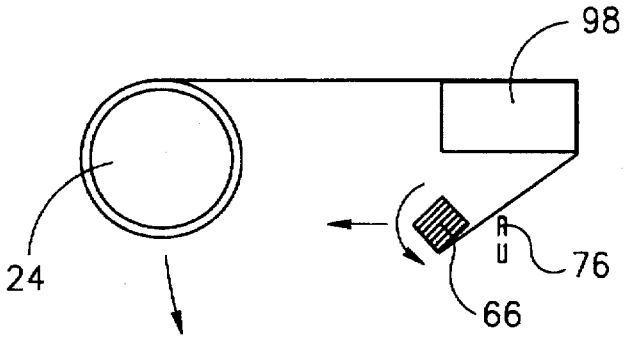

The opening of blade 68 is synchronized such that, when spool 24 has performed at least a quarter of a loop, and preferably is nearing the completion of its first loop, it catches on blade stop 72 and begins to turn rod 66 away from central stop 76, as shown in FIG. 7B. Once clear of central stop 76, rod 66 is in its release state, i.e., free to turn so as to release the end of the tape.

Figure 7C:
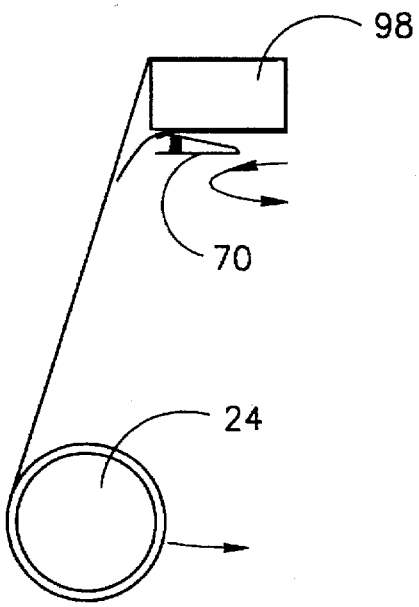

Continued opening of blade 68 carries rotatable collar 74 still further until resilient finger 70 reaches the position shown in FIG. 7C. In this position, resilient finger 70 helps to close the loose end of the tape against a facing piece of the tape being applied to item 98. This is particularly advantageous in a case in which the tape does not adhere well to item 98 directly as is typically the case, for example, with damp flowers. Mechanical linkage 18 then immediately begins to close blade 68 so that resilient finger 70 does not become caught in the tape.

Figure 6B:
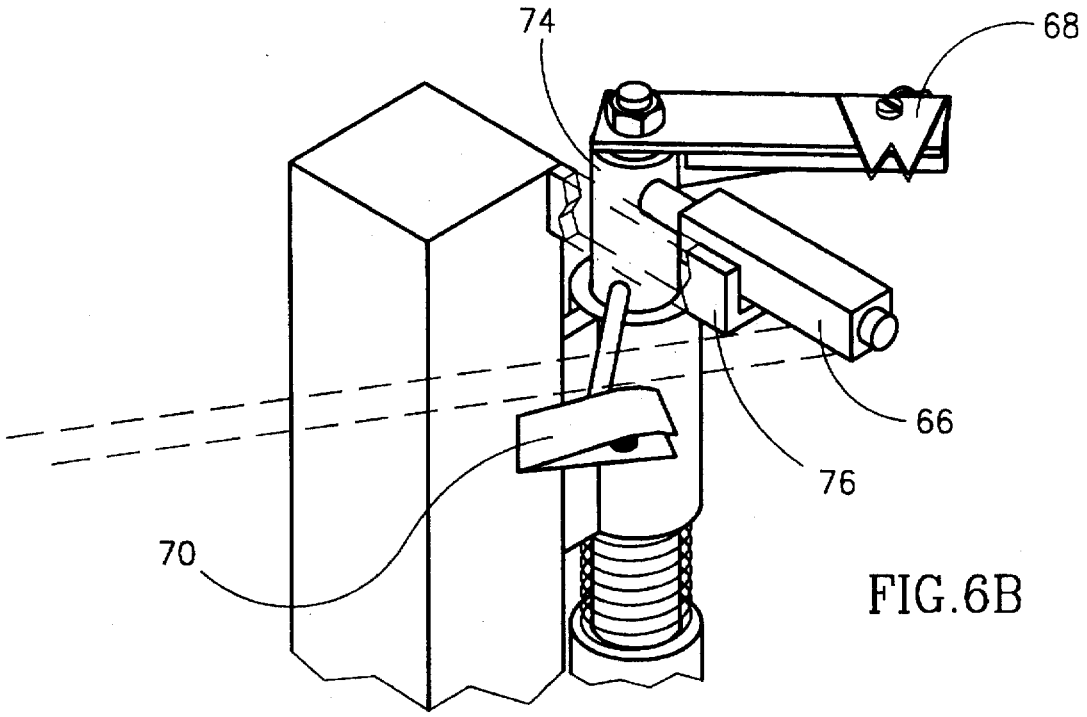
Figure 6C:
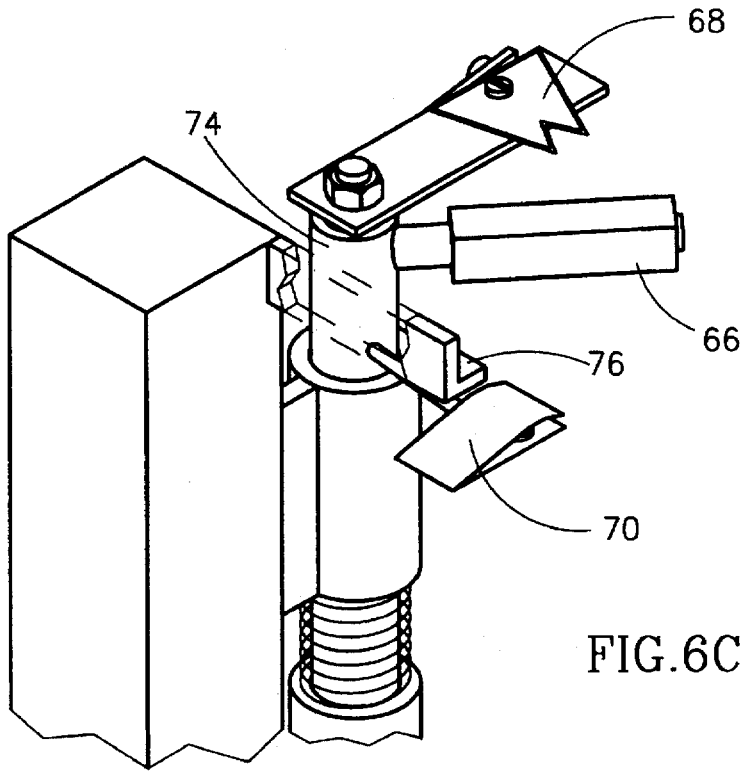
Figure 7D:
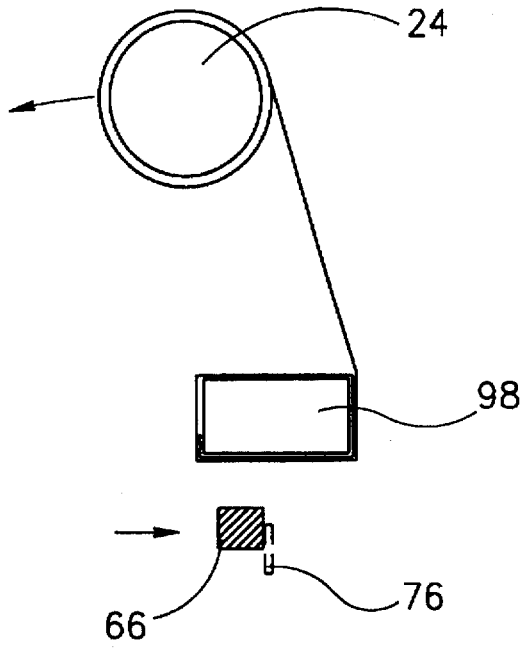
Figure 7E:
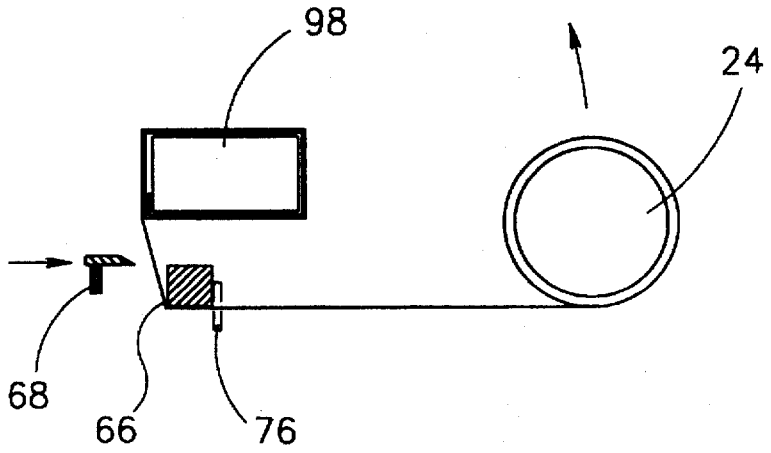

Blade 68 then closes to the position shown in FIG. 6B while spool 24 performs most of its second loop. In this position, rod 66 is in its primed state, i.e., locked to rotation by abutting central stop 76, while blade 68 is sufficiently open to avoid obstructing the path of the tape. This stage is represented in FIG. 7D. Towards the end of this second loop, the tape becomes caught on rod 66, "primed" ready for a subsequent taping operation.

Finally, as spool 24 returns to its starting position, blade 68 closes completely, thereby severing the tape and clamping the loose end against rod 66. Item 98 may then be lifted away with its double winding of tape firmly attached.

It will be appreciated that the above descriptions are intended only to serve as examples, and that many other embodiments are possible within the spirit and the scope of the present invention.

What is claimed is:

1. An apparatus for encircling at least one item with tape, the apparatus comprising:

(a) a spool assembly for dispensing the tape including:

(i) a spool for supplying the tape, (ii) a spring element attached to said spool so as to bias said spring element; and (b) a displacement mechanism for displacing said spool assembly in a closed path about the at least one item.

2. An apparatus as in claim 1, wherein said spring element biases said spool to recoil at least about two revolutions.

3. An apparatus as in claim 1, wherein said displacement mechanism includes a rotatable arm mounted on a hollow shaft, the apparatus further comprising a table for supporting the at least one item, said table being supported by a bar which extends through the hollow of said hollow shaft.

4. An apparatus as in claim 1, further comprising a tape control mechanism including a rod rotatable about its longitudinal axis, said rod assuming a primed state in which said rod is disposed between said closed path and the at least one item and is locked to rotation thereby allowing the tape to become caught thereon, and a release state wherein said rod is free to rotate thereby facilitating peeling away of the tape from said rod.

5. An apparatus as in claim 4, wherein said tape control mechanism further includes a flat stop, and wherein said rod is of polygonal section, said rod being rotatable around an axis perpendicular to the length of said rod between a position in which it abuts said flat stop corresponding to said primed state, and a position rotated away from said flat stop corresponding to said release position.

6. An apparatus as in claim 5, further comprising a mechanical linkage linking between said displacement mechanism and said tape control mechanism, said mechanical linkage rotating said rod from its primed state to its release state when said spool assembly has rotated through at least a quarter revolution.

7. An apparatus as in claim 6, wherein said mechanical linkage includes a cam associated with said displacement mechanism such that one revolution of said cam corresponds to a plurality of revolutions of said spool assembly.

8. An apparatus for encircling at least one item with tape, the apparatus comprising:

(a) a spool assembly for dispensing the tape;

(b) a displacement mechanism for displacing said spool assembly in a closed path about the at least one item; and (c) a tape control mechanism including:

(i) a rod rotatable about its longitudinal axis, and (ii) a locking mechanism for directly engaging said rod so as to lock said rod to rotation, said rod assuming a primed state in which said rod is disposed between said closed path and the at least one item and said locking mechanism locks said rod to rotation thereby allowing the tape to become caught thereon, and a release state wherein said rod is free to rotate thereby facilitating peeling away of the tape from said rod.

9. An apparatus as in claim 8, wherein said tape control mechanism further includes a flat stop, and wherein said rod is of polygonal section, said rod being rotatable around an axis perpendicular to the length of said rod between a position in which it abuts said flat stop corresponding to said primed state, and a position rotated away from said flat stop corresponding to said release position.

10. An apparatus as in claim 9, further comprising a mechanical linkage linking between said displacement mechanism and said tape control mechanism, said mechanical linkage rotating said rod from its primed state to its release state when said spool assembly has rotated through at least a quarter revolution.

11. An apparatus as in claim 10, wherein said mechanical linkage includes a cam associated with said displacement mechanism such that one revolution of said cam corresponds to two revolutions of said spool assembly.

* * * * *